United States Patent [19]

Nakano

[11] Patent Number: 4,749,021

[45] Date of Patent: Jun. 7, 1988

[54] MOLTEN METAL INJECTING DEVICE IN DIE CASTING MACHINE

[76] Inventor: Akio Nakano, 14-1, Ichikawaminami 3-chome, Ichikawa-shi, Chiba-ken, Japan

[21] Appl. No.: 934,660

[22] Filed: Nov. 25, 1986

[30] Foreign Application Priority Data

Nov. 30, 1985 [JP] Japan ..... 60-270483
Nov. 30, 1985 [JP] Japan ..... 60-270484

[51] Int. Cl.[4] ..... B22D 17/04
[52] U.S. Cl. ..... 164/316; 164/312
[58] Field of Search ..... 164/316, 317, 318, 312

[56] References Cited

U.S. PATENT DOCUMENTS 2,660,769 12/1953 Bennett ..... 164/156
4,408,651 11/1983 Smedley et al. ..... 164/316
4,556,098 12/1985 Hintermann et al. ..... 164/316

FOREIGN PATENT DOCUMENTS 60-76264 4/1985 Japan ..... 164/316

*Primary Examiner*—Kuang Y. Lin
*Attorney, Agent, or Firm*—Klauber & Jackson

[57] ABSTRACT

This invention relates to improvements on an injection device in a hot chamber type die casting machine in which molten metal reserved in a heat retaining furnace or the like is injected into a mold according to a hot pressurizing chamber system. A goose neck formed of ceramics is provided in a heat retaining pot formed of ceramics for reserving molten metal such that the bottom of the goose neck is attached fixedly to the inside surface of bottom of the heat retaining pot, and by additionally providing a heat retaining material incorporating a heating wire and formed of ceramics on the outer surface of bottom and the outer peripheral surface of the heat retaining pot is firmly fixed the goose neck in the heat retaining pot while shock load forces applied to the bottom of the goose neck are transmitted to the bottom of heat retaining pot and absorbed and reduced by the bottom and further the heat retaining pot is effectively reinforced by the heat retaining material.

11 Claims, 3 Drawing Sheets

MOLTEN METAL INJECTING DEVICE IN DIE CASTING MACHINE

FIELD OF THE INVENTION

This invention relates to a molten metal injecting device in a hot chamber type die casting machine for injecting molten metal stored in a heat retaining furnace or the like into a mold according to a hot pressurizing chamber system, and particularly to an injection device for injecting molten metal having temperature as high as 650–°1200° C.

DESCRIPTION OF PRIOR ART

Conventionally an injection device (B') of a hot chamber type die casting machine is constructed as shown in FIG. 3. A goose neck 33 for injecting molten metal into a mold 32 is attached suspensibly in a heat retaining pot 31 which is held by a holder bed 34.

Said injection device (B') thus constituted gives a piston motion to a plunger 35 through an injection cylinder 36 every time the molten metal is injected (every one shot) while shocks at that time and in opening and closing the metal mold 32 are transmitted to the goose neck 33 through a nozzle 37 so that problems are encountered in the holding portion and bottom of said goose neck 33 which are broken down through fatigue for a relative short time when the number of shots is increased.

These problems are presented since the goose neck 33 is constructed to be fixedly suspended and held simply in the heat retaining pot 31 so that the goose neck 33 cannot be secured firmly to the heat retaining pot 31 and holder bed 34.

Thus, to resolve said problems, an injection device (B'') constituted as shown in FIG. 4 is provided.

The injection device (B'') is provided with a goose neck 41 integral with a heat retaining pot 42 to increase the strength of the goose neck 41 subjected to said shocks, and along the outer surface of the heat retaining pot 42 with a heater 43 to hold said pot 42 with a holder bed 44 while the interior of the holder bed 44 is filled with granular ceramics 45 to support the bottom surface of the heat retaining pot 42, so that shock forces applied to the heat retaining pot 42 are absorbed by the granular ceramics 45 to protect the heat retaining pot 42 holding integrally the goose neck 41.

However, since said ceramics 45 used are granular ones, the shocks applied to the heat retaining pot 42 cannot be effectively absorbed, so that the heat retaining pot 42 cannot be effectively protected.

Also, while an injection device according to this invention aims particularly to inject molten metal having temperature as high as 650–°1200° C. heat resisting Meehanite, ductile cast iron, etc. usually used for material of the heat retaining pot and goose neck cannot practically resist against high temperature.

OBJECT AND OUTLINE OF THIS INVENTION

An object of this invention is to provide an injection device provided with shock resisting property capable of resisting shocks for a long period of use and heat resisting property capable of injecting molten metal having temperature as high as 650°–1200° C.

Another object of this invention is to provide a compact injection device.

A further object of this invention is to provide an injection device having an excellent effect in retaining molten metal temperature constant.

Still further object of this invention will be apparent from detailed description and drawings.

These objects can be achieved by the molten metal injection device in a die casting machine according to this invention.

A first injection device according to this invention has a heat retaining pot formed of ceramics for storing molten metal and a goose neck formed of ceramics and provided in the heat retaining pot, while a plunger is inserted in a cylinder of the goose neck to be subjected to a piston motion by an injection cylinder and a cylinder liner formed of ceramics is inserted in the cylinder of said goose neck. And the bottom of the goose neck is fixedly attached to the inside surface of the pot bottom, and a heat insulator formed of ceramics and a built-in heating wire are additionally provided on the outside surface of bottom and the outer peripheral surface of the heat retaining pot.

According to said constitution, the goose neck is supported with the bottom being fixedly attached to the inside surface of bottom of the heat retaining pot. Thus, the goose neck is secured fixedly to transmit a load force applied to the bottom of the goose neck to the bottom of the heat retaining pot.

Also, the heat insulator additionally attached to the outer peripheral surface and outside surface of bottom of said heat retaining pot heats the heat retaining pot while receiving a portion of shock force applied to the heat retaining pot.

A second injection device according to this invention comprises a goose neck formed of ceramics and provided vertically, a reservoir container formed of ceramics, storing molten metal and provided in an upper opening of the goose neck, a cylinder liner formed of ceramics, provided on the inner peripheral surface with a recessed path for sending molten metal and inserted in a cylinder of said goose neck, a plunger inserted in the cylinder to effect a piston motion by the injection cylinder and additionally a heat insulator formed of ceramics and having a heating wire built in the outer peripheral surface and the bottom surface of the goose neck.

According to said constitution, molten metal stored in the reservoir container provided in the upper opening of the goose neck passes through the molten metal sending path in the cylinder liner to be supplied into the cylinder and injected by the piston motion of the plunger.

The goose neck is attachably supported by the heat retaining material additionally provided on the goose neck and heating the goose neck while receiving a portion of shock force applied to the goose neck.

DETAILED DESCRIPTION OF THIS INVENTION

Figure 1:
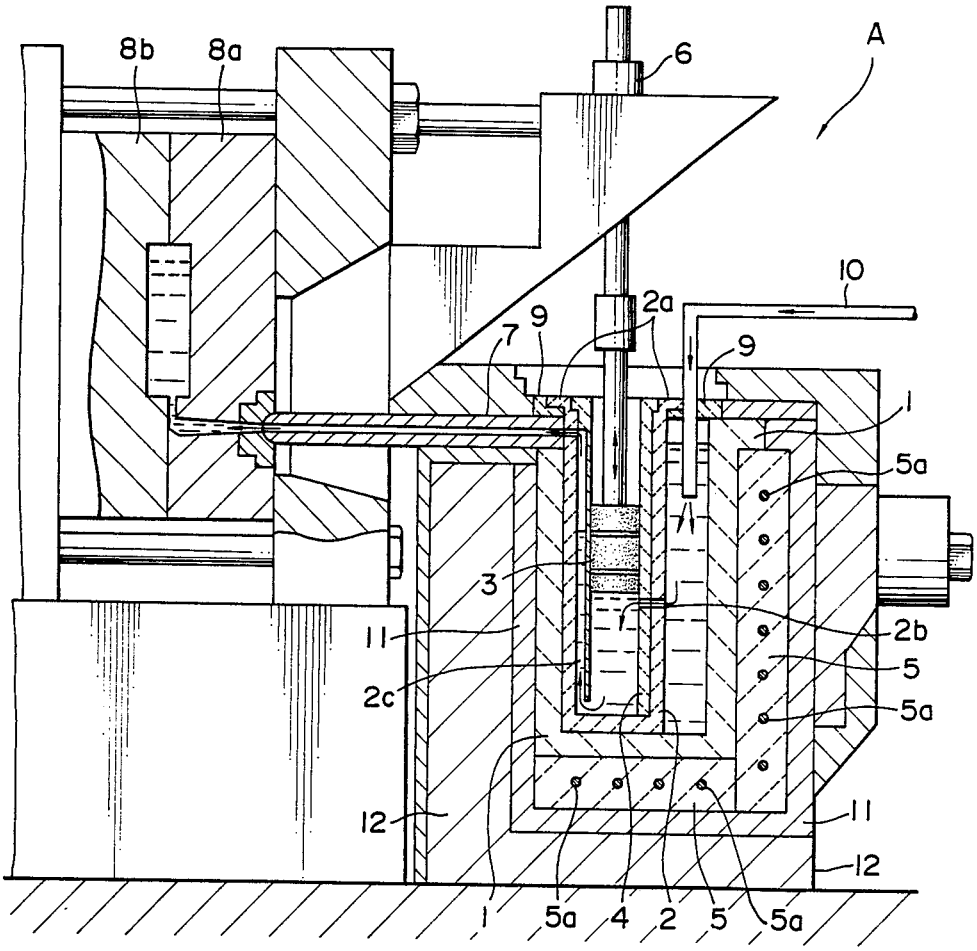
FIG. 1 is a longitudinal sectional front view of a first embodiment of this invention provided in a die casting machine.

FIG. 1 shows a first injection device (A) provided in a die casting machine according to this invention. This injection device (A) has a goose neck 2 formed of ceramics and built in a heat retaining pot 1 formed of ceramics for storing molten metal. A plunger 3 fitted in a cylinder of the goose neck 2 is given a piston motion by an injection cylinder 6 so that molten metal conducted into the cylinder passes through a nozzle 7 to be injected into coupled molds 8*a*, 8*b*.

A cylinder liner 4 formed of ceramics is inserted into the cylinder of said goose neck 2 and the bottom of the goose neck 2 is fixedly attached to the inside surface of the bottom of the heat retaining pot 1 while supporting an upper end collar 2*a* engaging a hole of a lid plate 9 formed of ceramics for sealing the heat retaining pot 1 to be firmly fixed to said bottom.

Molten metal stored in the heat retaining pot 1 from a melting furnace (not shown) through a melting metal feeding pipe 10 flows from an intake port 2*b* provided in the peripheral wall of the goose neck 2 into the cylinder, passes from the lower end of the cylinder liner 4 through a recessed injection path 2*c* provided in the peripheral surface of the liner 4 as the plunger 3 is lowered and is injected into the nozzle 7 connected to the upper end port of the injection path 2*c*. Further, the material of the plunger 3 should be ceramics since the cylinder liner 4 is formed of ceramics.

On the outer peripheral surface and the outer surface of the bottom of said heat retaining pot 1 is additionally provided a heat retaining material 5 for heating the heat retaining pot 1, and further this heat retaining material 5 and heat retaining pot 1 are held by an external housing 11 and mounted on a support bed 12.

The heat retaining material 5 is formed of ceramics, has a heating wire 5*a* of a, heat source built in the interior and is provided attached closely and abutting along predetermined portions of the outer peripheral surface and the outside surface of the bottom of the heat retaining pot 1 for reinforcing said pot.

Next, will be described said heat retaining pot 1, goose neck 2, plunger 3, cylinder liner 4, heat retaining material 5, lid plate 9 and composite structure of ceramics constituting these members.

Such ceramics are of solid solution havinq $\alpha$-$Si_3N_4$ structure, i.e. $\alpha$-sialon sintered body consisting of compact compound (solid solution) structure phase in which 60 vol % of $\alpha$-sialon granular crystals ($\alpha$phase) represented by $Mx(Si, Al)_{12}(O, N)_{16}$ (where M represents Mg, Ca, Y, etc.) are baked to form interstitial solid solution between 40 vol % of columnar crystals ($\beta$phase) of $\beta$-$Si_3N_4$. They are excellent in the mechanical property such as strength, hardness, breaking resilience value, etc., heat and shock resisting property and chemical resisting property within the composite range called "partially stabilized" $\alpha$-sialon range, i.e. range in which 60 vol % of $\alpha$-sialon granular crystals and 40 vol % of $\beta$-$Si_3N_4$ columnar crystals are present together.

An injection device (A) having said constitution attaches the bottom of goose neck 2 fixedly to the inside surface of bottom of the heat retaining pot 1 while supporting the upper end collar 2*a* engaging the lid plate for firm fixation so that the goose neck 2 is neither vibrated by shocks of plunger 3 and the like nor subjected to unreasonable load, and further since loads of molten metal pressure and shocks applied to the bottom of the goose neck 2 are absorbed by the heat retaining pot 1 and heat retaining material 5, the danger of breaking the bottom can be reduced.

Further, since the heat retaining pot 1 is reinforced by additionally providing the thick ceramics heat retaining material 5, the durability of the heat retaining pot 1 can be substantially improved.

According to said first invention, the bottom of the goose neck is supported by and attached fixedly to the inside surface of bottom of the heat retaining pot and further the heat retaining material formed of ceramics is additionally provided on the outside surface of the bottom and the outer peripheral surface of the heat retaining pot, so that the goose neck is firmly fixed to reduce the vibration caused by the shocks while a portion of the load force applied to the bottom of the goose neck can be absorbed by the bottom of the heat retaining pot so that the danger of breaking the goose neck caused by the shocks for a short period of time can be reduced.

Also, since the heat retaining pot is effectively reinforced by the heat retaining material made of said ceramics, the strength of the heat retaining pot itself can be substantially increased to receive the load of said goose neck with allowance of strength while improving the shock resisting property of the heat retaining pot itself so that, similarly to the goose neck, the durability is improved.

Further, since the goose neck, heat retaining pot and heat retaining material are formed of ceramics, the heat resisting property and heat retaining property of these members can be drastically improved so that molten metal having 650°–1200° C. of high temperature can be injected while the variation of molten metal temperature is reduced and the occurrence of defective products accompanying the variation of the molten metal temperature can be restrained.

Figure 2:
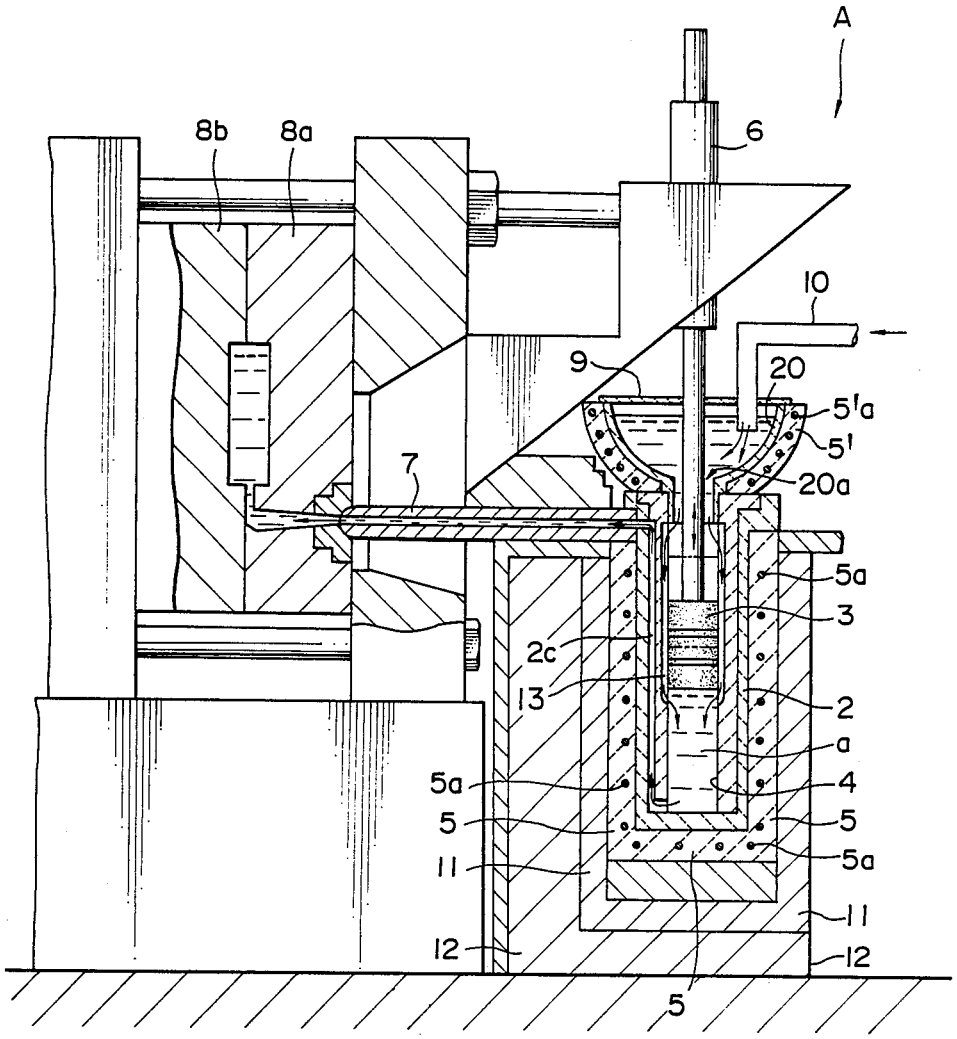
FIG. 2 is a longitudinal sectional front view of a second embodiment of this invention provided in the die casting machine.
Figure 3:
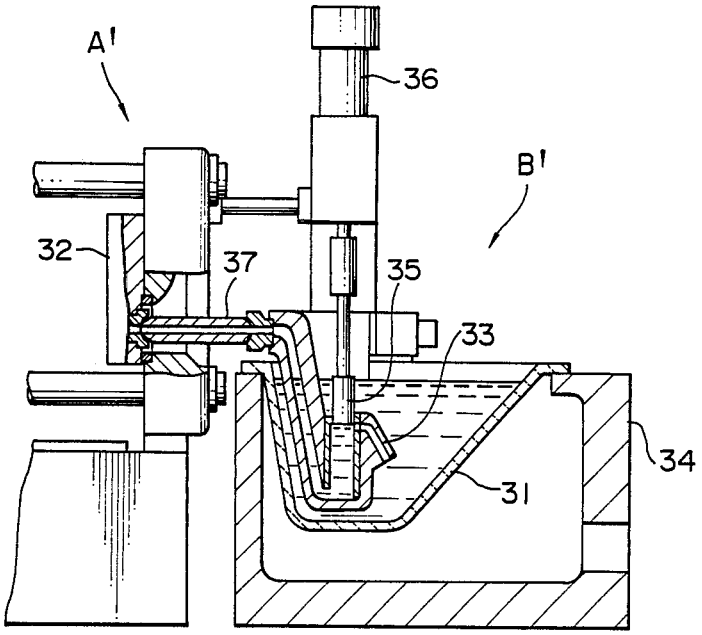
FIG. 3 PRIOR ART
FIGS. 3 and 4 are longitudinal sectional front views showing conventional examples.
Figure 4:
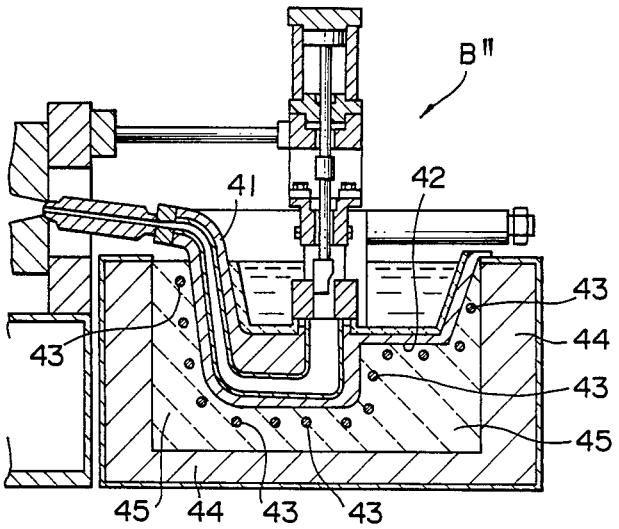
FIG. 4 PRIOR ART

Next, will be described an injection device (A) of second invention with reference to FIG. 2. This injection device (A) is constituted such that in the upper opening of the goose neck 2 formed of ceramics is provided a reservoir container 20 formed of ceramics for storing molten metal and a plunger 3 which is given a piston motion by an injection cylinder 6 is inserted in the cylinder of said goose neck 2.

In the cylinder of said goose neck 2 is inserted a cylinder liner 4 formed of ceramics and provided on the inner peripheral surface with a recessed path 13 for sending molten metal to smooth the contact with the plunger 3.

Further, since the cylinder liner 4 is formed of ceramics, the material of the plunger 3 should be ceramics.

Also, on the outer peripheral surface and bottom surface of said goose neck 2 is additionally provided a heat retaining material 5 provided in the interior with a heating wire 5 to retain the heat of molten metal in the cylinder, and the heat retaining material 5 and goose neck 2 are held by a machine frame 11 and mounted on a support bed 12.

The reservoir container 20 is formed of ceramics in the form of cup or the like and an opening 20*a* provided in the bottom surface is connectively fitted in the upper opening of the cylinder liner 4. On the outer surface of the container 20 is also additionally provided a heat retaining material 5′ provided in the interior with heating wire 5′*a* similarly to the goose neck 2 to retain the heat of molten metal reserved in the reservoir container 20 while reinforcing the container 20. The reservoir container 20 is enclosed with a lid plate 9 formed of ceramics to prevent the molten metal from oxidization and give the heat retaining effect.

Next, will be described simply the composite structure of ceramics constituted from said goose neck 2, plunger 3, reservoir container 20, lid plate 9, cylinder liner 4 and heat retaining material 5.

Such ceramics are of solid solution having $\alpha$-$Si_3N_4$ structure, i.e. $\alpha$-sialon sintered body consisting of compact compound (solid solution) structure phase in which 60 vol % of granular crystals ($\alpha$ phase) of $\alpha$-sialon represented by $Mx(Si, Al)_{12}(O, N)_{16}$ (where M is Mg, Ca, Y, etc.) is baked to form interstitial solid solution between 40 vol % of columnar crystals ($\beta$ phase) of $\beta$-$Si_3N_4$. They are excellent in the mechanical property such as strength, hardness, breaking resilience value, etc. and the heat and shock resisting property and chemical resisting property within the composite range called "partially stabilized" $\alpha$-sialon range, i.e. range in which 60 vol % of $\alpha$-sialon granular crystals and 40 vol % of $\beta$-$Si_3N_4$ columnar crystals are present together.

Molten metal supplied from a molten metal feeding pipe 10 communicating to a melting furnace (not shown) into the reservoir container 20 flows into the upper opening of cylinder and flows down through a molten metal feeding path 13 for affording communication between the upper opening edge and lower portion a of cylinder to be reserved in the lower portion a of cylinder. Molten metal in injection is passed from the lower end of the cylinder liner 4 through an injection path 2c provided recessed on the peripheral surface of the cylinder liner 4 and is injected from a nozzle 7 connected with the upper end port of the injection path 2c into molds 8a, 8b by lowering the plunger 3.

Since in said injection device (A) the whole peripheral surface and bottom surface of goose neck 2 are reinforced by the heat retaining material 5 formed of thick ceramics and additionally provided, the durability of the goose neck 2 can be improved, and since the goose neck 2 itself is firmly held by the heat retaining material 5, the goose neck 2 is neither vibrated by shocks caused by the plunger 3 or the like nor subjected to unreasonable load so that said durability is furthermore improved.

Further, since the heat retaining meterial 5' incorporating the heating wire 5'a and formed of ceramics is additionally provided on the outer peripheral surface of the reservoir container 20, molten metal reserved in the reservoir container 20 can be retained at a predetermined temperature. Also, said heat retaining material 5' serves also to reinforce the reservoir container 20 similarly to the heat retaining material 5 around the goose neck 2.

Since, according to said second invention, the reservoir container for storing molten metal is provided on the upper opening of the goose neck and the molten metal in the container is fed through the molten metal feeding path into the cylinder, a large-scaled heat retaining pot incorporating the goose neck like the injection device of conventional constitution is not needed so that a compact reservoir container for storing only necessary molten metal can be used instead of the heat retaining pot. Thus, the strength necessary for the compact reservoir container can be easily provided while the compact injection device can be attained.

Also, since the goose neck is firmly held by the heat retaining material, it reduces vibration caused by shocks while being effectively reinforced by the heat retaining material made of ceramics to improve the shock resisting property and durability of goose neck itself.

Further, since ceramics are used for the goose neck, reservoir container and heat retaining material, the heat resisting property, thermal shock resisting property and heat retaining property of these members are drastically improved so that high temperature molten metal can be injected while the variation of molten metal temperature can be reduced with the heat retaining effect of the heat retaining material and the occurrence of defective products accompanying the temperature variation of molten metal can be restrained.

What is claimed is:

1. A molten metal injecting device in a die casting machine, comprising:

a heating retaining pot formed of ceramics for holding molten metal and housed within a machine frame, a heat retaining material incorporating a heat wire and formed of ceramics provided in close, abutting relation between an inside peripheral surface of the machine frame and an outer peripheral surface of the heat retaining pot, a goose neck formed of ceramics and provided in the interior of the heat retaining pot, said goose neck having a bottom fixedly attached to an inside surface of a bottom of the heat retaining pot, a plunger slidably inserted in a cylinder of said goose neck, injection cylinder means for imparting reciprocal motion to said plunger, and a cylinder liner formed of ceramics and inserted in said goose neck, said heat retaining material being formed by a ceramic material of solid solution having an $\alpha$-$Si_3N_4$ structure defined by an $\alpha$-sialon sintered body, said sintered body consisting of a compact compound structure phase in which 60 volume percent of $\alpha$-sialon granular crystals represented by $Mx(Si,Al)_{12}(O,N)_{16}$ (where M is Mg, Ca, Y, etc.) are baked to form an interstitial solid solution of 40 volume percent of $\beta$-$Si_3N_4$ columnar crystals existing together.

2. A molten metal injecting device in a die casting machine as defined in claim 1, characterized in that an opening of the heat retaining pot is enclosed with a lid plate formed of ceramics.

3. A molten metal injecting device in a die casting machine as defined in claims 1 or 2, characterized in that the goose neck is formed on the upper end with a collar which fixedly engages the lid plate.

4. A molten metal injecting device in a die casting machine as defined in claim 1, characterized in that an inflow port through which molten metal in the heat retaining pot flows from the peripheral wall of the goose neck through the peripheral wall of the cylinder liner into the cylinder is provided.

5. A molten metal injecting device in a die casting machine as defined in claim 1, characterized in that the plunger is formed of ceramics.

6. A molten metal injecting device in a die casting machine as defined in claims 1 or 4, characterized in that a molten metal feeding pipe communicates the heat retaining pot directly to a heat retaining furnace.

7. A molten metal injecting device in a die casing machine, comprising:

a goose neck formed of ceramics and installed vertically within an inside of a frame of a die casting machine, a heat retaining material incorporating a heat wire and formed of ceramics provided in close, abutting relation between a peripheral inside surface of the frame of the machine and an outer peripheral surface of the goose neck, a reservoir container formed of ceramics for reserving molten metal provided at an upper opening of the goose neck, a cylinder liner formed of ceramics and provided on an inner peripheral surface with a molten metal feeding recessed path, said cylinder liner being inserted into said goose neck, a plunger inserted into the goose neck, injection cylinder means for imparting reciprocal motion to said plunger, said heat retaining material being formed by a ceramic material of solid solution having an $\alpha$-$Si_3N_4$ structure defined by an $\alpha$-sialon sintered body, said sintered body consisting of a compact compound structure phase in which 60 volume percent of $\alpha$-sialon granular crystals represented by $Mx(Si,Al)_{12}(O,N)_{16}$ (where M is Mg,Ca, Y, etc.) are baked to form an interstitial solid solution of 40 volume percent of $\beta$-$Si_3N_4$ columnar crystals existing together.

8. A molten metal injecting device in a die casting machine as defined in claim 7, characterized in that the opening of the reservoir container is enclosed with a lid plate formed of ceramics.

9. A molten metal injecting device in a die casting machine as defined in claim 7, characterized in that the cylinder liner is formed on the peripheral surface with an injection path extending from below.

10. A molten metal injecting device in a die casting machine as defined in claim 7, characterized in that the plunger is formed of ceramics.

11. A molten metal injecting device in a die casting machine as defined in claim 7, characterized in that a molten metal feeding pipe communicating to a melting furnace is connected directly to the reservoir container.

* * * * *